US006888505B2

(12) United States Patent
Tran

(10) Patent No.: US 6,888,505 B2
(45) Date of Patent: May 3, 2005

(54) MICROELECTROMECHANICAL SWITCH (MEMS) ANTENNA ARRAY

(75) Inventor: Allen Tran, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 94 days.

(21) Appl. No.: 10/371,564

(22) Filed: Feb. 21, 2003

(65) Prior Publication Data

US 2004/0164922 A1 Aug. 26, 2004

(51) Int. Cl.[7] ..... H01Q 1/24
(52) U.S. Cl. ..... 343/702; 343/833; 343/834
(58) Field of Search ..... 343/700 MS, 793, 343/795, 833, 834, 876

(56) References Cited

U.S. PATENT DOCUMENTS 6,392,610 B1 * 5/2002 Braun et al. ..... 343/876
6,417,807 B1 * 7/2002 Hsu et al. ..... 343/700 MS
6,600,456 B2 * 7/2003 Gothard et al. ..... 343/834

* cited by examiner

*Primary Examiner*—Michael C. Wimer

(57) ABSTRACT

A microelectromechanical switch (MEMS) beam-steering antenna array is provided. The antenna comprises an active element including a selectively connectable MEMS, and a lattice of beam-forming parasitic elements, each including a selectively connectable MEMS, proximate to the active element. In some aspects, the active element is a dipole radiator having an effective quarter-wavelength odd multiple length at a first plurality of frequencies in response to connecting radiator MEMS. Likewise, the dipole counter-poise has an effective quarter-wavelength odd multiple length at the first plurality of frequencies in response to connecting counterpoise MEMS. Further, each parasitic element has an effective half-wavelength odd multiple length at the first plurality of frequencies in response to connecting their corresponding MEMS. In other aspects, the active element is a monopole and includes a radiator with a radiator MEMS, a counterpoise groundplane, and parasitic elements with MEMSs.

51 Claims, 11 Drawing Sheets

MICROELECTROMECHANICAL SWITCH (MEMS) ANTENNA ARRAY

BACKGROUND OF THE INVENTION

1. Field of the Invention

This invention generally relates to wireless communications antennas and, more particularly, to a selectable antenna array formed from a microelectromechanical switch.

2. Description of the Related Art

The size of portable wireless communications devices, such as telephones, continues to shrink, even as more functionality is added. As a result, the designers must increase the performance of components or device subsystems while reducing their size, or placing these components in less desirable locations. One such critical component is the wireless communications antenna. This antenna may be connected to a telephone transceiver, for example, or a global positioning system (GPS) receiver.

Wireless telephones can operate in a number of different frequency bands. In the US, the cellular band (AMPS), at around 850 megahertz (MHz), and the PCS (Personal Communication System) band, at around 1900 MHz, are used. Other frequency bands include the PCN (Personal Communication Network) at approximately 1800 MHz, the GSM system (Groupe Speciale Mobile) at approximately 900 MHz, and the JDC (Japanese Digital Cellular) at approximately 800 and 1500 MHz. Other bands of interest are GPS signals at approximately 1575 MHz and Bluetooth at approximately 2400 MHz.

Conventionally, good communication results have been achieved using a whip antenna. Using a wireless telephone as an example, it is typical to use a combination of a helical and a whip antenna. In the standby mode with the whip antenna withdrawn, the wireless device uses the stubby, lower gain helical coil to maintain control channel communications. When a traffic channel is initiated (the phone rings), the user has the option of extending the higher gain whip antenna. Some devices combine the helical and whip antennas. Other devices disconnect the helical antenna when the whip antenna is extended. However, the whip antenna increases the overall form factor of the wireless telephone.

It is known to use a portion of a circuitboard, such as a dc power bus, as an electromagnetic radiator. This solution eliminates the problem of an antenna extending from the chassis body. Printed circuitboard, or microstrip antennas can be formed exclusively for the purpose of electromagnetic communications. These antennas can provide relatively high performance in a small form factor. However, a wireless device that is expected to operate at a plurality of different frequencies may have difficulty housing a corresponding plurality of microstrip antennas. Even if all the microstrip antennas could be housed, the close proximity of the several microstrip antennas may degrade the performance of each antenna.

In some circumstances it is advantageous to be able to shape an antenna pattern. Then, the antenna pattern has additional gain in a desired direction, to improve the link margin with a communicating device. It is known to network a plurality of antenna elements and regulate the phase relationship between elements. The phase relationship between elements generates the antenna beam pattern. Likewise, an active element can be arrayed in a field, or lattice of parasitic elements. A lattice is a substantially symmetrical arrangement having two or more members. These parasitic elements, being either half-wavelength open radiators or quarter-wavelength ground-shunted radiators, can also be used to shape an antenna beam pattern. Unlike the phase-array antenna, whose pattern can easily be varied by electronic means, the parasitic elements must be manipulated by mechanical means if the beam is to shaped in a different form. Mechanical manipulation generally requires additional parts that take up room and degrade reliability. As a result, parasitic element lattices have not been practical for use in portable wireless communication devices.

FIG. 20 is a schematic diagram of a microelectromechanical switch (MEMS) (prior art). A MEMS is a semiconductor integrated circuit (IC) with an overlying mechanical layer that operates as a selectable connectable switch. That is, the underlying solid-state layer creates a field that can cause an overlying conductive material to move, permitting the conductive material to act as miniature single-pull single-throw switch. MEMS concepts were developed in labs in the 1980's and are just now beginning to be fabricated as practical products. As a result, the particular specifications and features of a MEMS are still under development. MEMS technology offers the possibility of extremely low loss switches miniature switches.

It would be advantageous if a single wireless communications telephone antenna could be made to operate at a plurality of frequencies using MEMS devices.

It would also be advantageous if the antenna beam pattern of the above-mentioned multi-frequency MEMS antenna could be controlled.

It would be advantageous if the MEMS devices could be used to vary the electrical length of parasitic elements in a parasitic element antenna array.

SUMMARY OF THE INVENTION

The present invention provides a microstrip, or printed circuitboard antenna that is made with MEMSs to vary the actual physical length of the printed line active element radiators. The MEMSs can be used to form selectable connected conductive sections that vary the length of the antenna active element, thereby changing the antenna operating frequency. In addition, the active element is situated in a lattice of MEMS parasitic elements. The MEMS devices in the parasitic elements serve two purposes; they vary the length of the parasitic element to operate at different frequencies, and they vary the length to control the beam shape of the antenna.

Accordingly, a microelectromechanical switch (MEMS) beam-steering antenna array is provided. The antenna comprises an active element including a selectively connectable MEMS, and a lattice of beam-forming parasitic elements, each including a selectively connectable MEMS, proximate to the active element.

In some aspects, the active element is a dipole radiator having an effective quarter-wavelength odd multiple length at a first plurality of frequencies in response to connecting radiator MEMS. Likewise, the dipole counterpoise has an effective quarter-wavelength odd multiple length at the first plurality of frequencies in response to connecting a counterpoise MEMS. Further, each parasitic element has an effective half-wavelength odd multiple length at the first plurality of frequencies in response to connecting their corresponding MEMS.

In other aspects, the active element is a monopole and includes a radiator having an effective quarter-wavelength odd multiple length at a first plurality of frequencies in response to connecting radiator MEMS. The active element also includes a counterpoise groundplane. The parasitic elements are connected to the counterpoise and have an effective quarter-wavelength odd multiple length at the first plurality of frequencies in response to connecting their corresponding MEMS.

Additional details of the above-described MEMS antenna array, and a method for beam-forming in an antenna array, are provided below.

DETAILED DESCRIPTION OF THE PREFERRED EMBODIMENTS

Figure 1:
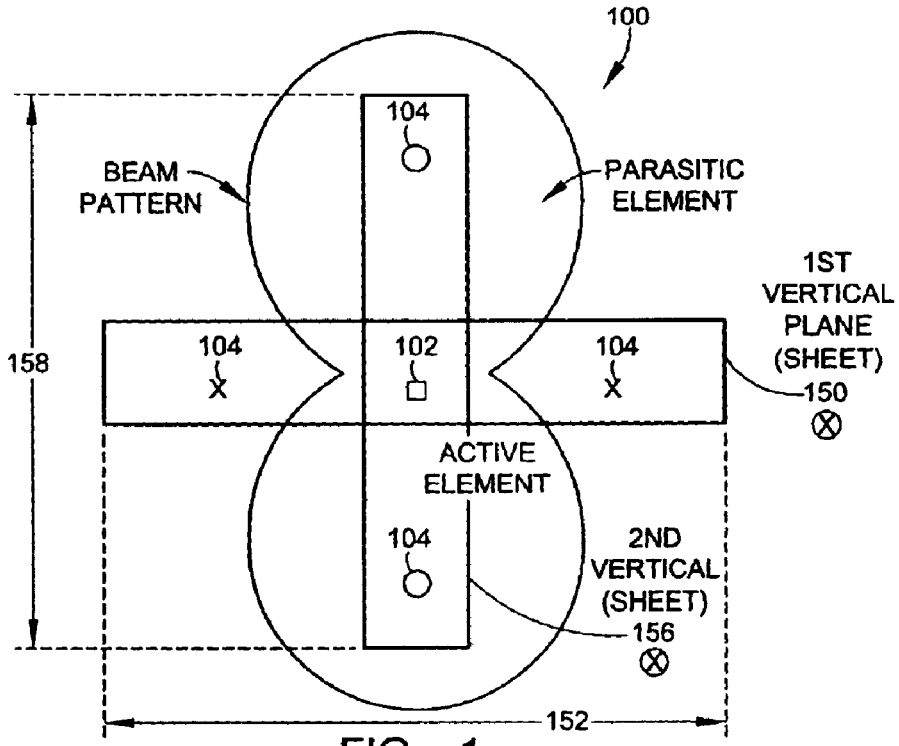
FIG. 1 is a plan view of the present invention microelectromechanical switch (MEMS) beam-steering antenna array.

FIG. 1 is a plan view of the present invention microelectromechanical switch (MEMS) beam-steering antenna array. The antenna array 100 comprises an active element 102 including a selectively connectable MEMS and a lattice of beam-forming parasitic elements 104. Each parasitic element includes a selectively connectable MEMS, proximate to the active element 102. The "X" pattern indicates an engaged parasitic element 104 and an "O" pattern represents a disengaged parasitic element 104. FIG. 1 depicts one possible parasitic element lattice and the resulting antenna pattern.

Figure 18:
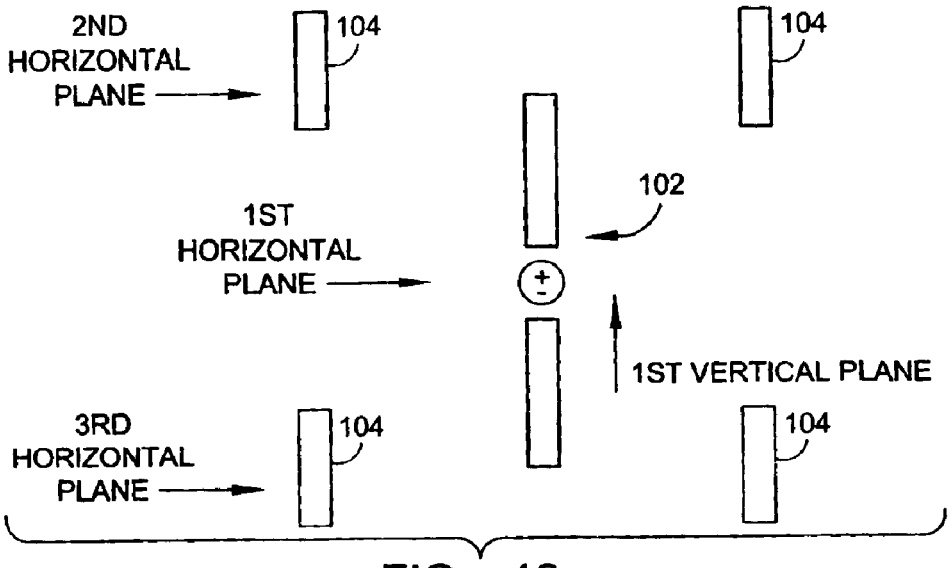
FIG. 18 is a depiction of the present invention antenna array with parasitic elements in a different horizontal plane than the active element.

As shown in the partially cross-sectional view of FIG. 18, each MEMS 200 includes a dielectric layer 202 and a conductive line 204, with a selectively connectable MEMS conductive section 206, formed overlying the dielectric layer.

Figure 2:
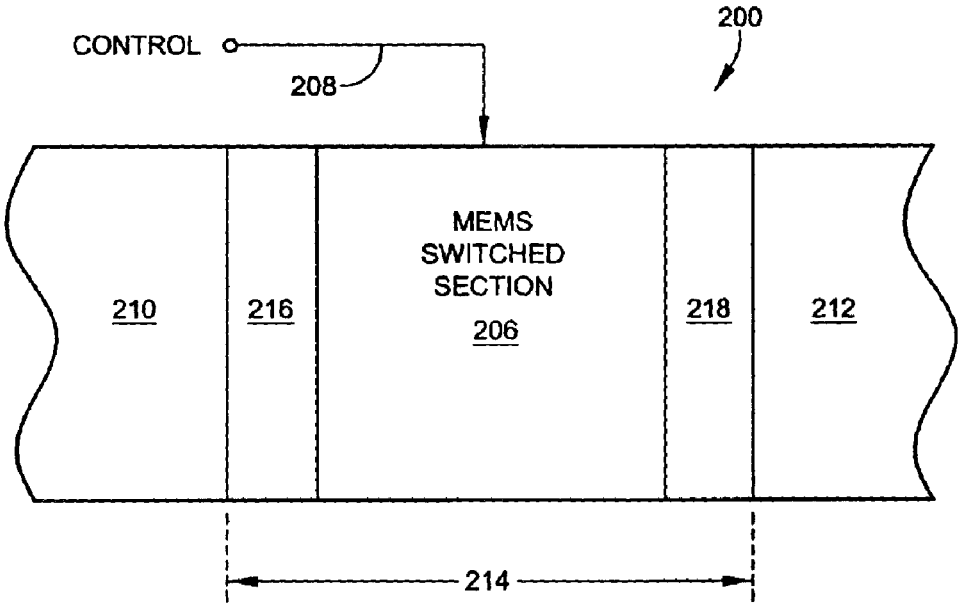
FIG. 2 is a more detailed plan depiction of a MEMS device, suitable for use in either an active element or a parasitic element.

FIG. 2 is a more detailed plan depiction of a MEMS device 200, suitable for use in either an active element or a parasitic element. The MEMS 200 has a control input on line 208, a signal input at connected to a first conductive section 210, and a signal output connected to a second conductive section 212. The signal output is selectively connected to the signal input in response to the control signal.

Each MEMS 200 has a mechanical length 214 responsive to connecting its corresponding MEMS conductive, or switched section 206. The MEMS device can be considered a conductive section with a length represented by reference designator 214 when closed. As shown, the MEMS device 200 has fixed length sections 216 and 218 that can be considered to be part of a connected fixed-length conductive section, even when the MEMS device is open. However, in some aspects of the invention the lengths represented by 216 and 218 can be zero. Alternately stated, the length of the MEMS device can be a result of only the switched section 206, or a combination of the switched section 206, with fixed-length sections 218 and 218.

Figure 3:
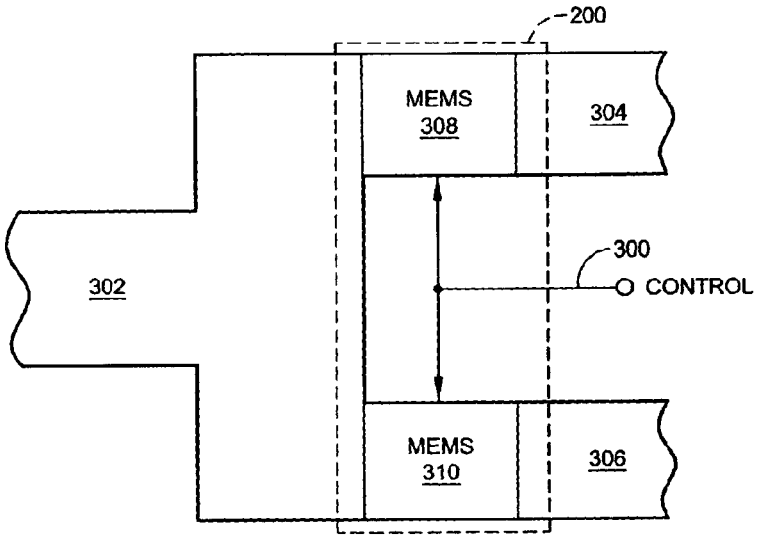
FIG. 3 is a depiction of a variation of the MEMS of FIG. 2.

FIG. 3 is a depiction of a variation of the MEMS 200 of FIG. 2. The MEMS 200, shown surrounded by dotted lines, has a control input 300, a signal input connected to a first radiator conductive section 302, and a plurality of signal outputs connected to corresponding plurality of radiator sections. One of the signal outputs is selectively connected to the signal input in response to the control signal on line 300. The radiator has a plurality of selectable lengths corresponding to the MEMS signal outputs.

As specifically shown, the plurality equals two, so that MEMS 200 has a first signal output connected to a second conductive section 304 and a second signal output connected to a third conductive section 306. Then, the conductor has a first length responsive to connecting the first and second conductive sections 302/304 through the MEMS section 308, and a second length responsive to connecting the first and third conductive sections 302/306 through the MEMS section 310. Although a two signal output MEMS device is shown, it should be understood that the present invention is not limited to any particular number of MEMS signal outputs.

Figure 4:
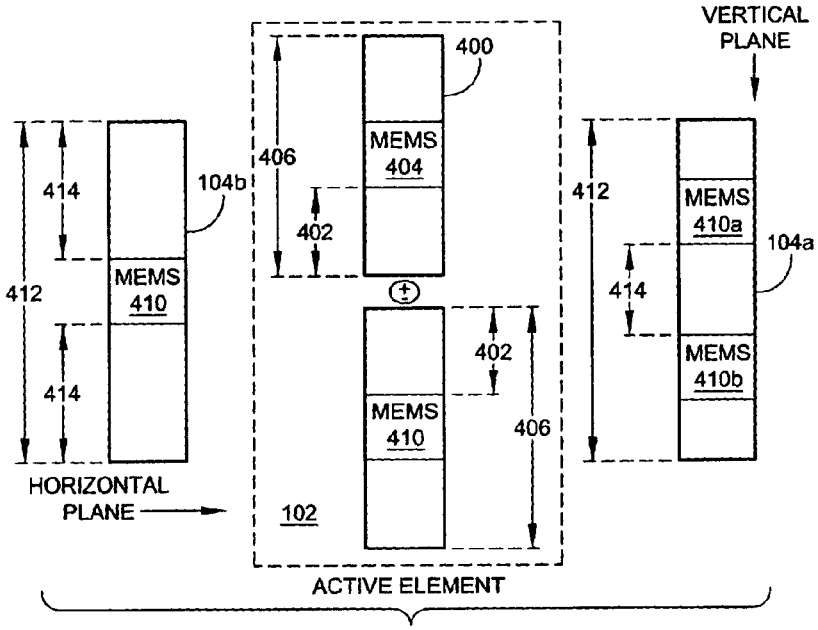
FIG. 4 is a partial cross-section view of the present invention antenna embodied as a dipole antenna.

FIG. 4 is a partial cross-section view of the present invention antenna embodied as a dipole antenna. The antenna array active element 102 comprises a radiator 400 having an effective quarter-wavelength odd multiple length 402 at a first frequency responsive to connecting a radiator MEMS 404 and an effective quarter-wavelength odd multiple length 406 at a second frequency responsive to disconnecting the radiator MEMS 404. An effective quarter-wavelength odd multiple length is $(2n+1)(\lambda/4)$, where n=0, 1, 2, . . .

Likewise, a counterpoise 408 has an effective quarter-wavelength odd multiple length 402 at the first frequency responsive to connecting a counterpoise MEMS 410 and an effective quarter-wavelength odd multiple length 406 at a second frequency responsive to disconnecting the counterpoise MEMS 410.

Each parasitic element 104*a* and 104*b* has an effective half-wavelength odd multiple length 412 at the first frequency responsive to connecting their corresponding MEMS 414 and 416. That is, a wavelength of (2n+1) (λ/2), where n=0, 1, 2, . . . Each parasitic element 104*a* and 104*b* has an effective quarter-wavelength odd multiple length 414 at a second frequency responsive to disconnecting their corresponding MEMS 410. Note that the parasitic elements are open (not connected to the active element).

As shown, parasitic element 104*a* has two MEMS, 410*a* and 410*b*. The use of multiple MEMS permits the half-wavelength length 414 to be precisely placed. As shown, second length 414 is centered in the same horizontal plane as the active element 102, between the radiator and the counterpoise. As can be easily extrapolated from the figure, the more MEMS sections there are included in a parasitic (or radiator) element, the more options there are available for the planar placement of the half-wavelength section. The parasitic element 104*b* includes only a single, centered MEMS 410, so that two separate second lengths 414 are formed. In other aspects not shown, the MEMS 410 need not be centered, and the disconnection of the MEMSs need not necessarily form multiple second length sections.

Note that FIG. 4 depicts only two parasitic elements in the same vertical plane as the active element. However, the present invention antenna array is not limited to any particular number of parasitic elements pre vertical plane. Further, the antenna array will typically have parasitic elements in more than one vertical plane, as explained in more detail below. Referring briefly to FIG. 1, parasitic elements are shown in two different vertical planes, where the vertical planes extend into the sheet.

It can be extrapolated from the previous discussion, that the present invention dipole active element could include the radiator having an effective quarter-wavelength odd multiple length at a first plurality of frequencies in response to connecting a second plurality of radiator MEMSs. Likewise, the counterpoise would have an effective quarter-wavelength odd multiple length at the first plurality of frequencies in response to connecting a second plurality of counterpoise MEMSs. Further, each parasitic element would have an effective half-wavelength odd multiple length at the first plurality of frequencies in response to connecting their corresponding second plurality of MEMSs. The above explanation assumes that the number of MEMSs in the radiator (or counterpoise) equals the number of MEMSs in each parasitic element. However, in other aspects of the invention the number of MEMSs in a parasitic element may differ from the number of MEMSs in the radiator. For example, in FIG. 4 the number of MEMSs included in the radiator is one, and the number of MEMSs in parasitic element 104*b* is two.

Figure 5:
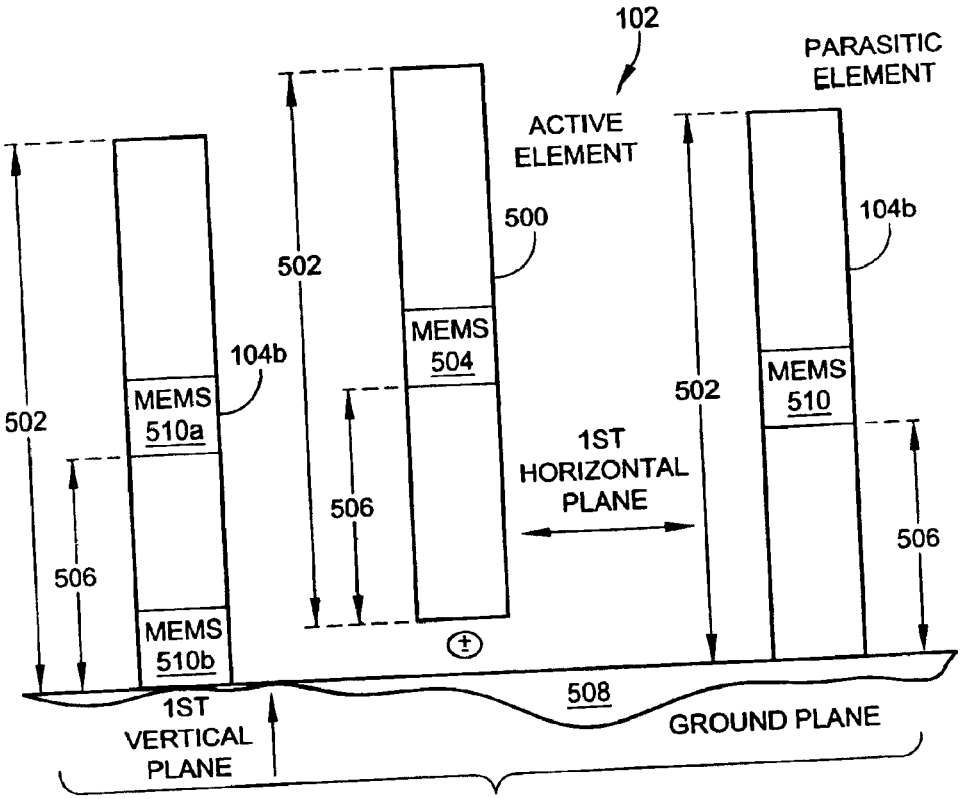
FIG. 5 is a partial cross-sectional view of the present invention antenna array depicted as a monopole antenna.

FIG. 5 is a partial cross-sectional view of the present invention antenna array depicted as a monopole antenna. The active element 102 includes a radiator 500 having an effective quarter-wavelength odd multiple length 502 at a first frequency responsive to connecting a radiator MEMS 504. The radiator 500 has an effective quarter-wavelength odd multiple length 506 at a second frequency responsive to disconnecting the radiator MEMS 504. Also shown is a counterpoise groundplane 508.

Parasitic elements 104*a* and 104*b* are connected to the counterpoise 508 and have an effective quarter-wavelength odd multiple length 502 at the first frequency in response to connecting their corresponding MEMS 510. The parasitic elements have an effective quarter-wavelength odd multiple length 506 at a second frequency responsive to disconnecting their corresponding MEMS 510.

Note that parasitic element 104*a* is enabled with a single MEMS 510, while parasitic element 104*b* is enabled with two MEMSs 510*a* and 510*b*. As above, the present invention conductive sections (radiator or parasitic element) are not limited to any particular number or placement of MEMSs.

It can be generally extrapolated from the above discussion that the monopole active element radiator can have an effective quarter-wavelength odd multiple length at a first plurality of frequencies in response to connecting a second plurality of radiator MEMSs. In the example shown in FIG. 5, the first plurality is equal to two. Generally, the present invention monopole would include a counterpoise groundplane, and parasitic elements connected to the counterpoise. The parasitic elements would have an effective quarter-wavelength odd multiple length at the first plurality of frequencies in response to connecting their corresponding MEMS.

Returning to FIGS. 1 and 5, the active element includes a radiator with a length, for example length 502, formed along a first vertical plane and bisected in a first horizontal plane. The first vertical plane is the up/down (width) direction of the sheet in FIG. 5 and is directed into the sheet when viewing FIG. 1. The first horizontal plane is parallel to the sheet surface in FIG. 1 and in the lengthwise direction in FIG. 5. Likewise, the lattice includes parasitic elements having lengths parallely aligned to the radiator along the first vertical plane and bisected in the first horizontal plane, in response to connecting (or disconnecting) the parasitic element MEMS. The elements are bisected in the first horizontal plane in the sense that the first horizontal plane intersects the approximate mid-length of the elements. However, the various elements may be bisected at different points other than their mid-lengths. As presented in more detail below, the elements may even be placed in different horizontal planes. Note that the above-mentioned orientation of radiator and parasitic elements applies to both dipole and monopole versions of the antenna array.

In some aspects, the radiator has a position in a second vertical plane. As shown, the second vertical plane is orthogonal to the first vertical plane, but it need not necessarily be so. This plane can be seen in FIG. 1 and is directed into the sheet. The lattice includes parasitic elements formed in the second vertical plane each having a length parallely aligned to the radiator in the vertical second plane and bisected in the first horizontal plane, in response to connecting their corresponding MEMS.

Figure 6:
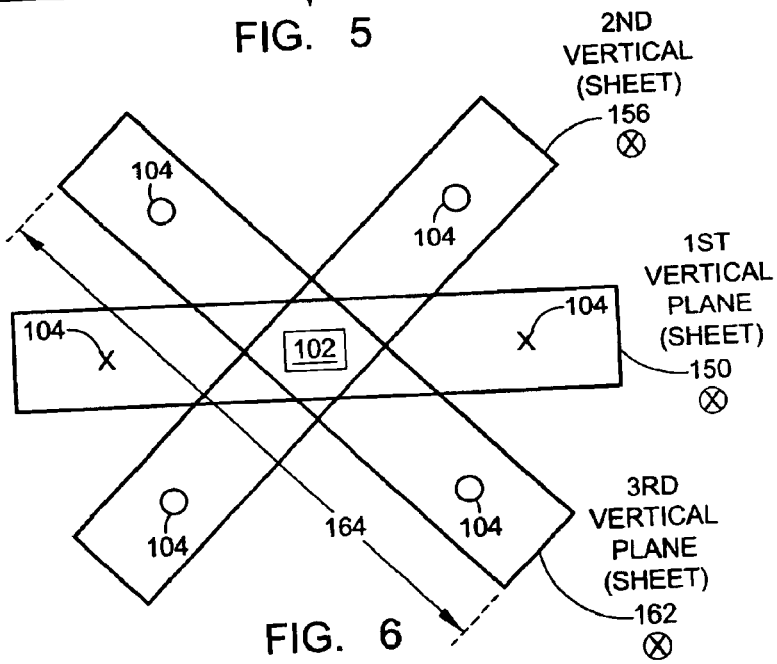
FIG. 6 is a plan view of the present invention antenna featuring a third vertical plane.

FIG. 6 is a plan view of the present invention antenna featuring a third vertical plane. As in FIG. 1, first and second vertical planes are directed into the sheet. Note that the first and second vertical planes need not necessarily be orthogonal. Also shown is a third vertical plane, different from the first and second vertical planes, again directed into the sheet. The radiator 102 has a position in a third vertical plane and the lattice includes parasitic elements having lengths parallely aligned to the radiator in the vertical third plane and bisected in the first horizontal plane, in response to connecting their corresponding MEMS. The third vertical plane need not necessarily be orthogonal to either the first or second vertical planes. Although only two parasitic elements are shown in each vertical plane, the present invention is not limited to any particular number of parasitic elements pre plane. In some aspects, the vertical planes are separated from each other by 120 degrees.

Figure 7:
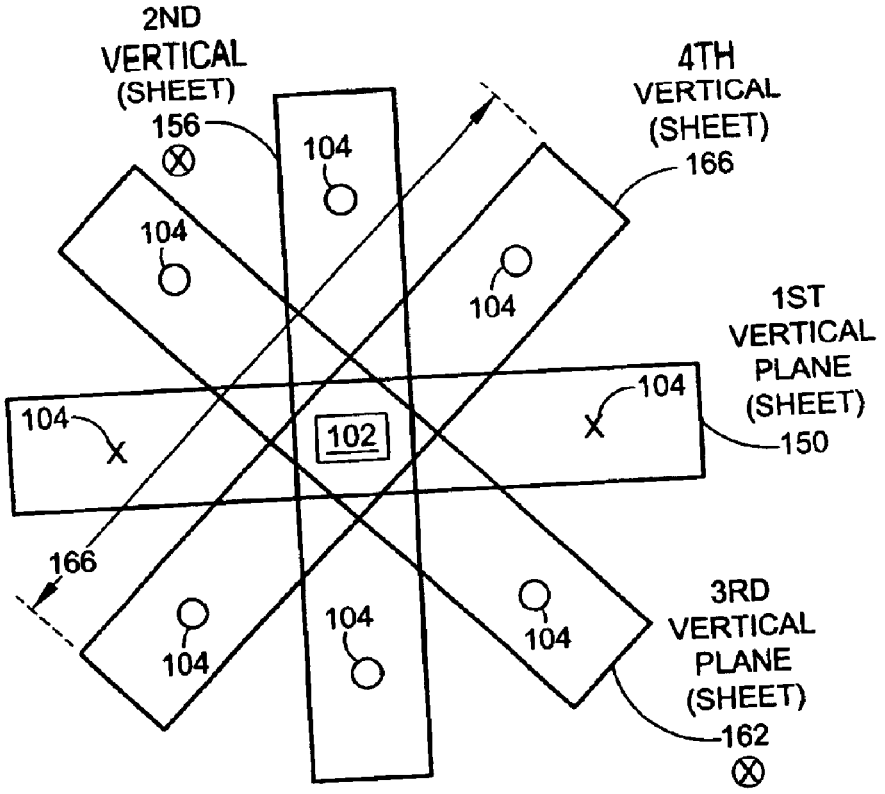
FIG. 7 is a plan view of the present invention antenna featuring a fourth vertical plane.

FIG. 7 is a plan view of the present invention antenna featuring a fourth vertical plane. Again, the radiator or active element 102 has a position in a fourth vertical plane. The lattice includes parasitic elements having lengths parallely aligned to the radiator in the fourth vertical plane and bisected in the first horizontal plane, in response to connecting their corresponding MEMS. As shown, the first vertical plane is orthogonal to the second vertical plane, and the third vertical plane is orthogonal to the fourth vertical plane. However, the present invention antenna array is not limited to any particular orientations when the parasitic elements are arrayed in four vertical planes. Further, although only two parasitic elements are shown in each vertical plane, the present invention is not limited to any particular number of parasitic elements pre plane.

Figure 8:
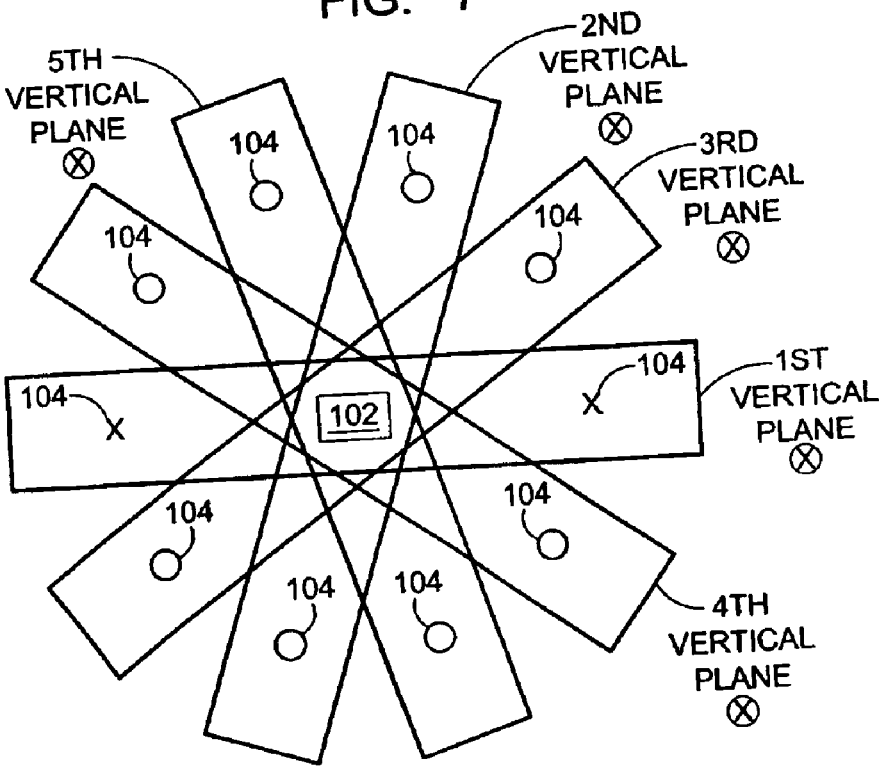
FIG. 8 is a plan view of the present invention antenna featuring a fifth vertical plane.

FIG. 8 is a plan view of the present invention antenna featuring a fifth vertical plane. Again, the radiator or active element 102 has a position in a fifth vertical plane. The lattice includes parasitic elements having lengths parallely aligned to the radiator in the fifth vertical plane and bisected in the first horizontal plane, in response to connecting their corresponding MEMS. The present invention antenna array is not limited to any particular orientations when the parasitic elements are arrayed in five vertical planes. Further, although only two parasitic elements are shown in each vertical plane, the present invention is not limited to any particular number of parasitic elements pre plane.

Figure 9:
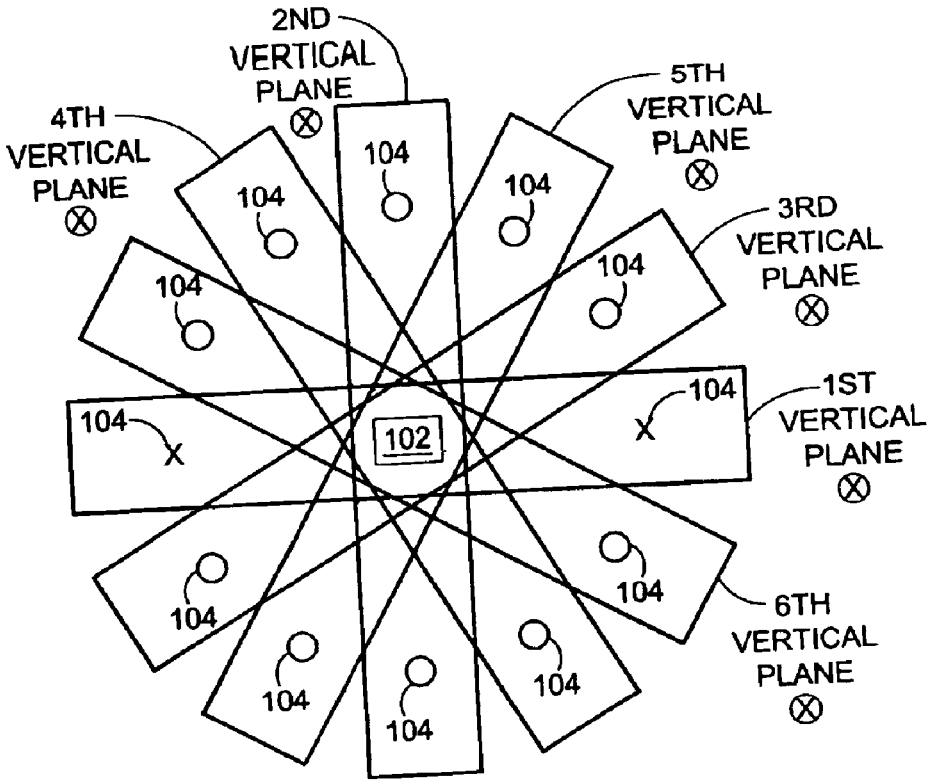
FIG. 9 is a plan view of the present invention antenna featuring a sixth vertical plane.

FIG. 9 is a plan view of the present invention antenna featuring a sixth vertical plane. Again, the radiator or active element 102 has a position in a sixth vertical plane. The lattice includes parasitic elements having lengths parallely aligned to the radiator in the sixth vertical plane and bisected in the first horizontal plane, in response to connecting their corresponding MEMS. As shown, the first vertical plane is orthogonal to the second vertical plane, the third vertical plane is orthogonal to the fourth vertical plane, and the fifth vertical plane is orthogonal to the sixth vertical plane. However, the present invention antenna array is not limited to any particular orientations when the parasitic elements are arrayed in six vertical planes. Further, although only two parasitic elements are shown in each vertical plane, the present invention is not limited to any particular number of parasitic elements pre plane.

Generally, FIGS. 1 and 6–9 can be extrapolated to support the position that a first plurality of parasitic elements can be used to form a second plurality of vertical planes though the radiator position, in response to connecting their corresponding MEMS.

In some aspects of the invention, the parasitic elements are conductive lines that are etched or deposited on a dielectric sheet, such as a printed circuit board (PCB). These materials are a primary component of most electronic devices, and in some aspects other circuit elements, signal lines, or power line traces may also be mounted on the PCB with the antenna array elements.

Referring again to FIG. 1, in one aspect of the invention a plurality of parasitic elements (two are shown) are formed on a first sheet of dielectric material 150 having sheet length 152 (along the sheet surface) and a sheet width in the first vertical plane. Typically, the parasitic elements would be formed as microstrip (MS) structures overlying the dielectric. The formation of MS transmission line and antenna components is conventionally known by those skilled in the art. Further, the parasitic elements could be embedded in dielectric, with a dielectric layer overlying and underlying the conductive lines and MEMS devices. Likewise, the radiator 102 can be a conductive line formed on the first dielectric sheet 150. That is, the active elements can also be formed as MS structures overlying or embedded in a dielectric material.

Figure 10:
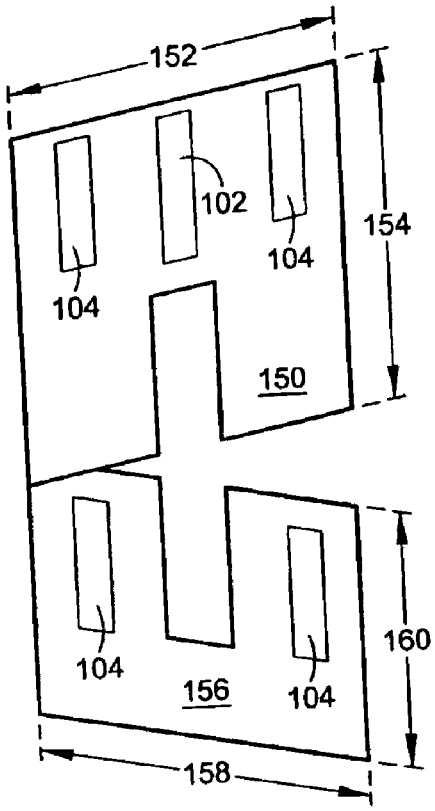
FIG. 10 is a perspective drawing depicting, in further detail, an aspect of FIG. 1.

FIG. 10 is a perspective drawing depicting, in further detail, an aspect of FIG. 1. Shown are the first sheet 150, the first sheet length 152, and the sheet width 154. Parasitic elements 104 are formed in the first sheet 150. The active element 102 is shown formed in the first dielectric sheet 150, but the radiator need not necessarily be formed on the same dielectric sheet as the parasitic elements.

Returning to FIG. 1, a plurality of parasitic elements 104 are formed on a second sheet of dielectric material 156 having sheet length 158 and a sheet width in the second vertical plane. Returning to FIG. 10, the second sheet 156, second sheet length 158, and second sheet width 160 are shown. Note that sheets 150 and 156 have been slotted so that the sheets can be joined to form an "X" shaped structure.

Returning to FIG. 6, a plurality (two are shown) of parasitic elements 104 are formed on a third sheet of dielectric material 162 having sheet length 164 and a sheet width (into the sheet) in the third vertical plane. Again, the third sheet 162 can be slotted to mate with the first and second sheets.

Returning to FIG. 7, a plurality (two are shown) of parasitic elements 104 are formed on a fourth sheet of dielectric material 166 having sheet length 168 and a sheet width in the fourth vertical plane. The fourth sheet 166 can be slotted to mate with the first, second, and third sheets. Likewise, the antenna array fifth vertical plane can be enabled with a fifth sheet of dielectric material (FIG. 8) and the sixth vertical plane can be enabled with a sixth sheet of dielectric material (FIG. 9). Generally, it can be extrapolated from the explanation of the above-described figures that a first plurality parasitic elements can be formed on a second plurality of dielectric sheets, where each dielectric sheet has a sheet length and a sheet width in a second plurality of vertical planes. In one aspect of the invention, the active element and all the parasitic elements are embedded in a single block, or one thick sheet of dielectric material. For example, the antenna array can be formed as a multilayer substrate.

Figure 11:
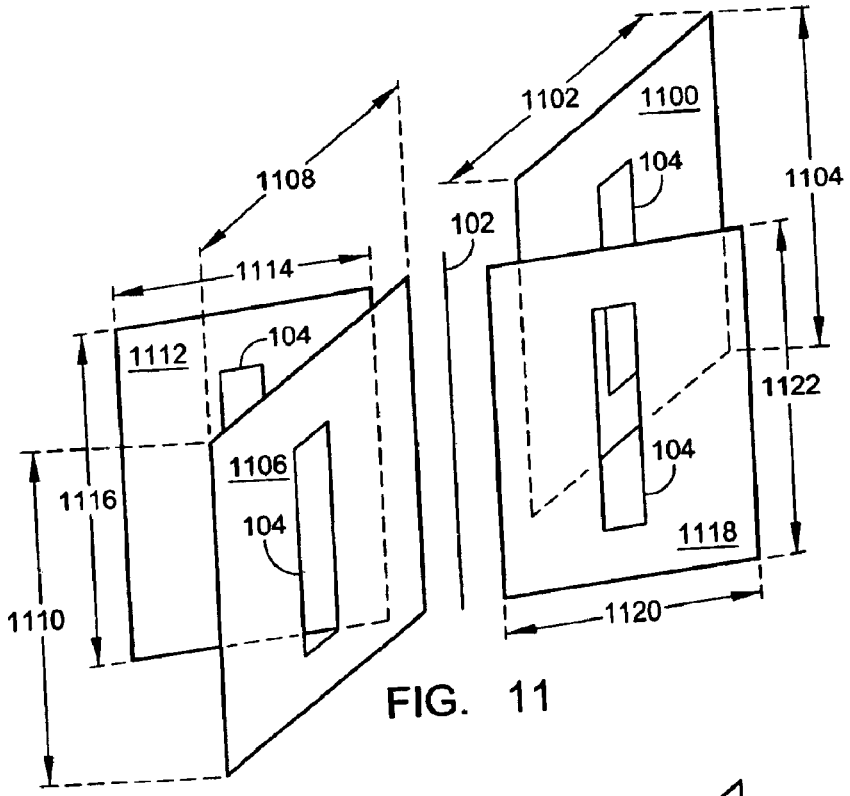
FIG. 11 is a perspective drawing illustrating an embodiment where parasitic elements in the same vertical plane are formed on separate dielectric sheets.

FIG. 11 is a perspective drawing illustrating an embodiment where parasitic elements in the same vertical plane are formed on separate dielectric sheets. At least one parasitic element 104 is formed on a first sheet of dielectric material 1100 having sheet length 1102 and a sheet width 1104 in the first vertical plane. Likewise, at least one parasitic element 104 is formed on a second sheet of dielectric material 1106 having a sheet length 1108 and a sheet width 1110 in the first vertical plane. The radiator or active element 102 is interposed between the first and second sheets 1100/1106 in the first plane. Note that the active element 102 may, in some aspects of the antenna array, be formed on either the first or second dielectric sheet 1100/1106.

In some aspects at least one parasitic element 104 is formed on a third sheet of dielectric material 1112 having sheet length 1114 and a sheet width 1116 in the second vertical plane. Then, at least one parasitic element is formed on a fourth sheet of dielectric material 1118 having sheet length 1120 and a sheet width 1122 in the second vertical plane. Again, the radiator is interposed between the third and fourth sheets 1112/1118 in the second vertical plane.

Figure 12:
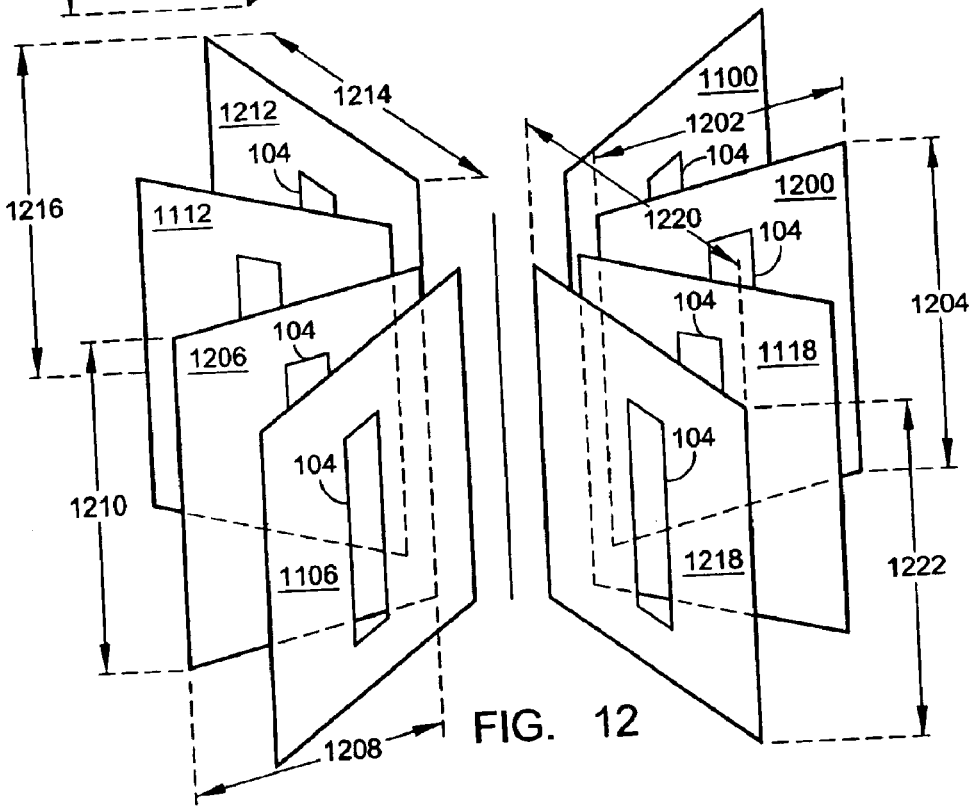
FIG. 12 is a perspective drawing featuring additional parasitic elements formed on separate sheets of dielectric material.

FIG. 12 is a perspective drawing featuring additional parasitic elements formed on separate sheets of dielectric material. At least one parasitic element 104 is formed on a fifth sheet of dielectric material 1200 having sheet length 1202 and a sheet width 1204 in the third vertical plane. The third vertical plane is equivalent to the third vertical plane referenced in FIG. 7. At least one parasitic element 104 is formed on a sixth sheet of dielectric material 1206 having sheet length 1208 and a sheet width 1210 in the third vertical plane. The radiator 102 is interposed between the fifth and sixth sheets 1200/1206 in the third vertical plane.

In some aspects, at least one parasitic element 104 is formed on a seventh sheet of dielectric material 1212 having sheet length 1214 and a sheet width 1216 in the fourth vertical plane. The fourth vertical plane is equivalent to the fourth vertical plane referenced in FIG. 8. At least one parasitic element 104 is formed on an eighth sheet of dielectric material 1218 having sheet length 1220 and a sheet width 1222 in the fourth vertical plane. The radiator 102 is interposed between the seventh and eighth sheets 1212/1218 in the fourth vertical plane.

Figure 13:
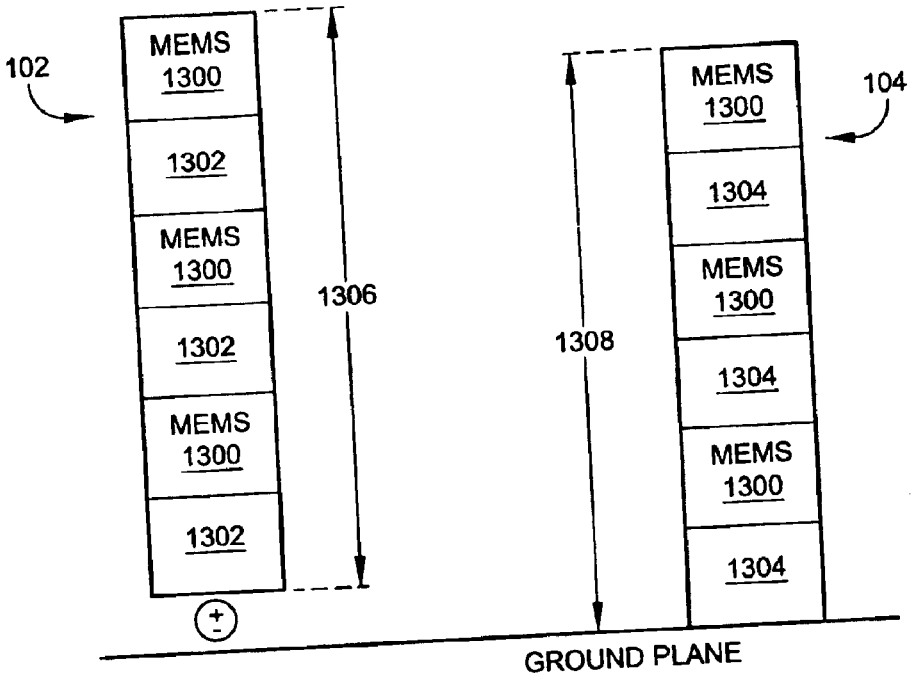
FIG. 13 is diagram depicting further details associated with the use of MEMS devices in an antenna element.

FIG. 13 is diagram depicting further details associated with the use of MEMS devices in an antenna element. As mentioned above, the active element 102 of any of the above-described antenna arrays may include a plurality of selectively connectable MEMSs 1300. As shown, the active element 102 includes three MEMSs, although the invention is not limited to any particular number MEMSs. The use of three MEMSs permits the radiator to be formed to four distinct physical (mechanical) lengths, so that the antenna can efficiently operate at four different frequency bands. For use in a wireless communications device telephone for example, the active element 102 can be used to communicate at frequencies such as 824 to 894 megahertz (MHz), 1850 to 1990 MHz, 1565 to 1585 MHz, or 2400 to 2480 MHz.

Likewise, each parasitic element 104 (one is shown that is representative of the others) may include a plurality of selectively connectable MEMSs. Again, the use of the several MEMSs permits the overall antenna beam to be shaped at each of the four operating frequencies. Although a monopole antenna is shown, the same principles apply to the operation of the present invention dipole antenna.

More specifically, the active element includes at least one fixed-length conductive section 1302. Likewise, the parasitic element 104 includes at least one fixed-length conductive section 1304. In some aspects of the antenna, the active element 102 includes a fixed-length conductive section 1302 and a plurality of MEMSs 1300. Likewise, each parasitic element 104 includes a fixed-length conductive section 1304 and a plurality of MEMSs 1300.

As actually shown, the active element 102 includes a plurality of fixed-length conductive sections 1302 and a plurality of MEMSs 1300. Just as the active element is not limited to any particular number of MEMSs, the active element (and parasitic element) are not limited to any particular number of fixed length conductive sections. Also shown, the parasitic element 104 includes a plurality of fixed-length conductive sections 1304 and a plurality of MEMSs 1300.

Also as shown, the active element 102 includes a fixed-length conductive section 1302 in series with a MEMS 1300. More specifically, the active element fixed-length conductive section 1302 is in series with a plurality of MEMSs 1300. Even more specifically, the active element 102 includes a plurality of fixed-length conductive sections 1302 in series with a plurality of MEMSs 1300. Likewise, the parasitic element 104 includes a fixed-length conductive section 1304 in series with a MEMS 1300. More specifically, a fixed-length conductive section 1304 is shown in series with a plurality of MEMSs 1300. Further, a plurality of fixed-length conductive sections 1304 are shown in series with a plurality of MEMSs 1300.

Alternately, it can be stated that the active element 102 includes a radiator with a length 1306 and a plurality of MEMSs 1300 aligned along the radiator length 1306. Likewise, the parasitic element 104 has a length 1308 and a plurality of MEMSs 1300 aligned along the length 1308.

Figure 14:
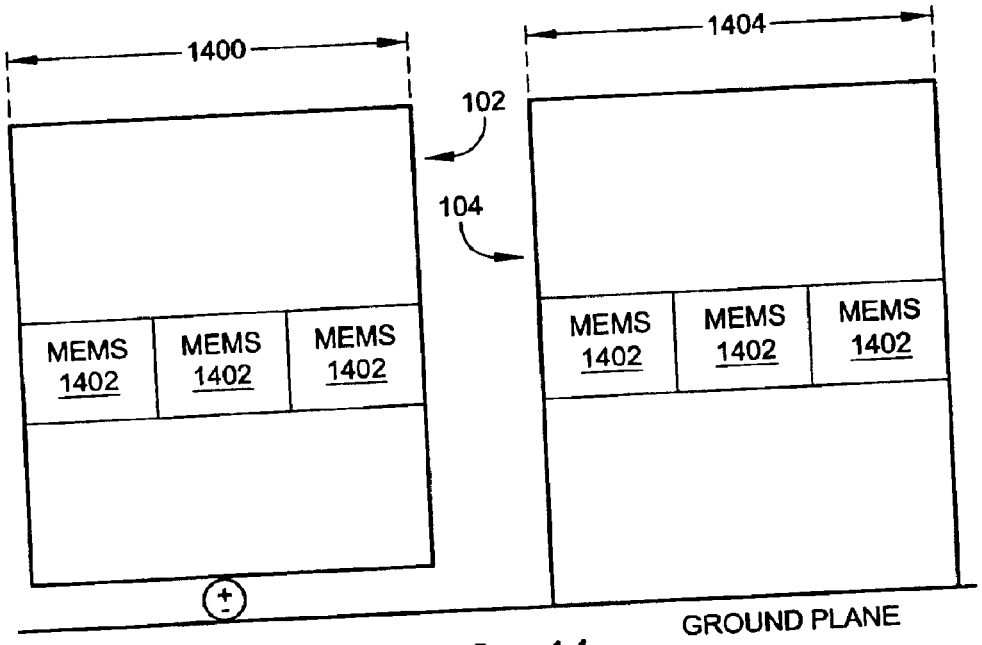
FIG. 14 is diagram depicting an alternate use of the MEMS devices in selecting the length of active and parasitic elements.

FIG. 14 is diagram depicting an alternate use of the MEMS devices in selecting the length of active and parasitic elements. In some aspects of the antenna array, the active element 102 includes a radiator with a width 1400 and a plurality of MEMSs 1402 parallely aligned along the radiator width 1400. Three MEMSs 1402 are shown in parallel, but the present invention is not limited to any particular number. Likewise, the parasitic element 104 (one is shown that is representative of the other parasitic elements in the array) has a width 1404 and includes a plurality of MEMSs 1402 parallely aligned along the width 1404. Although a monopole antenna is shown, the same principles apply to the operation of the present invention dipole antenna. Although MEMSs are only shown aligned along the elements widths, in some aspects they are aligned along the element length (see FIG. 13) and width simultaneously.

Figure 15:
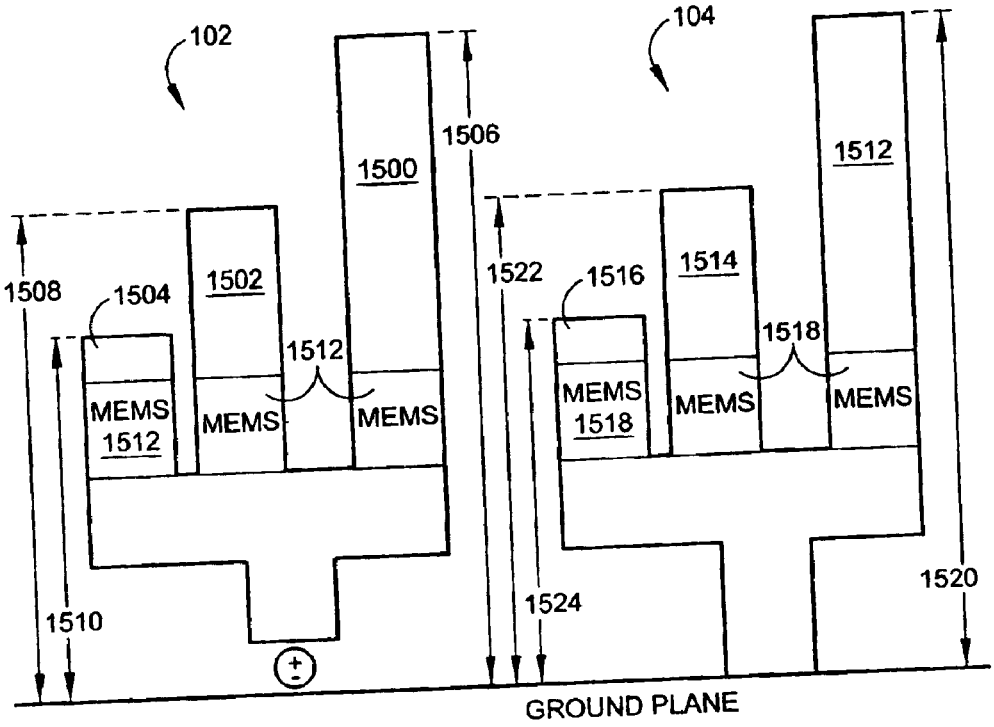
FIG. 15 is a drawing illustrating another variation of a multi-frequency antenna array enabled with MEMS devices.

FIG. 15 is a drawing illustrating another variation of a multi-frequency antenna array enabled with MEMS devices. This aspect of the invention is related to the use of the multiple signal output MEMS device described by FIG. 3. The active element 102 includes a radiator with a first plurality of fixed-length conductive sections 1500/1502/1504 connected to a first plurality of MEMS signal outputs. In this example the first plurality is equal to three, but the invention is not limited to any particular number. The radiator has an effective quarter-wavelength odd multiple length 1506/1508/1510 at the first plurality of frequencies in response to connecting one of the first plurality of radiator fixed length conductive sections 1500/1502/1504 through the radiator MEMS 1512. Likewise, each parasitic element 104 (one is shown that is representative of the others) includes a first plurality of fixed-length conductive sections 1512/1514/1516 connected to a first plurality of signal outputs of their corresponding MEMS 1518. The parasitic element 104 has an effective quarter-wavelength odd multiple length 1520/1522/1524 at the first plurality of frequencies in response to connecting one of the first plurality of fixed length conductive sections 1512/1514/1516 through their corresponding MEMS 1518.

Figure 16:
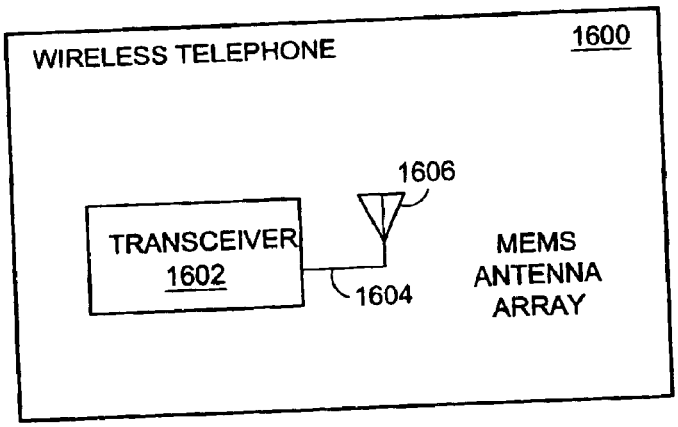
FIG. 16 is a schematic block diagram of the present invention wireless telephone communications device.

FIG. 16 is a schematic block diagram of the present invention wireless telephone communications device. The telephone 1600 comprises a transceiver 1602 with an antenna port on line 1604. The transceiver 1602 can be a telephone transceiver, a global positioning system (GPS) receiver, or a Bluetooth transceiver. The telephone 1600 further comprises a MEMS antenna array 1606. The MEMS antenna array 1606 includes an active element with selectively connectable MEMS as described above. The MEMS antenna array 1606 further includes a lattice of beam-forming parasitic elements, including selectively connectable MEMSs, proximate to the active element as described in detail above.

In some aspects, the active element is a dipole. Alternately, it is a monopole. In some aspects, the antenna array 1606 communicates at frequencies such as 824 to 894 megahertz (MHz) (cell), 1850 to 1990 MHz (PCS), 1565 to 1585 MHz (GPS), or 2400 to 2480 MHz (Bluetooth).

Figure 17A:
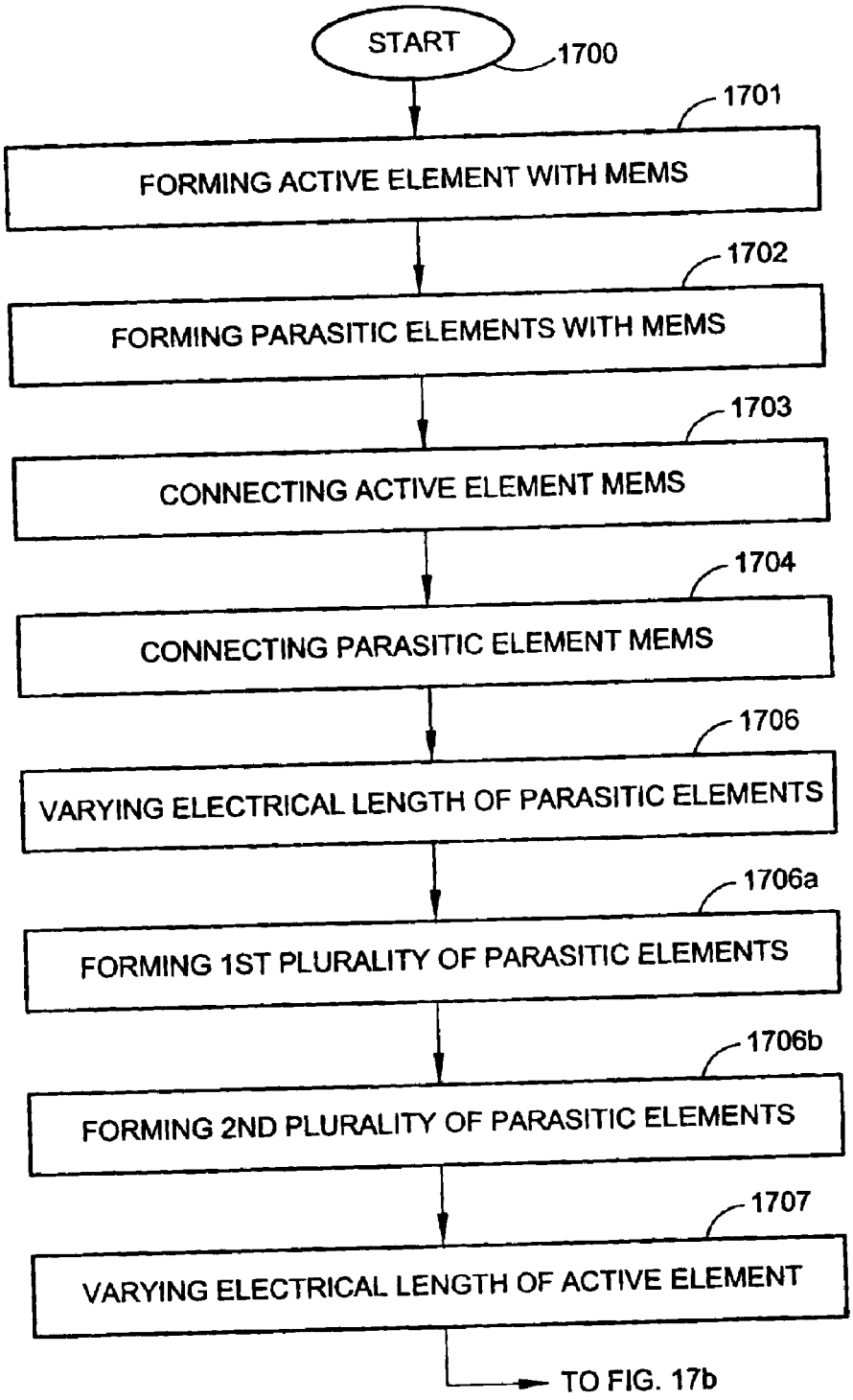
FIGS. 17*a* and 17*b* are flowcharts illustrating the present invention method for beam-forming in an antenna array.
Figure 17B:
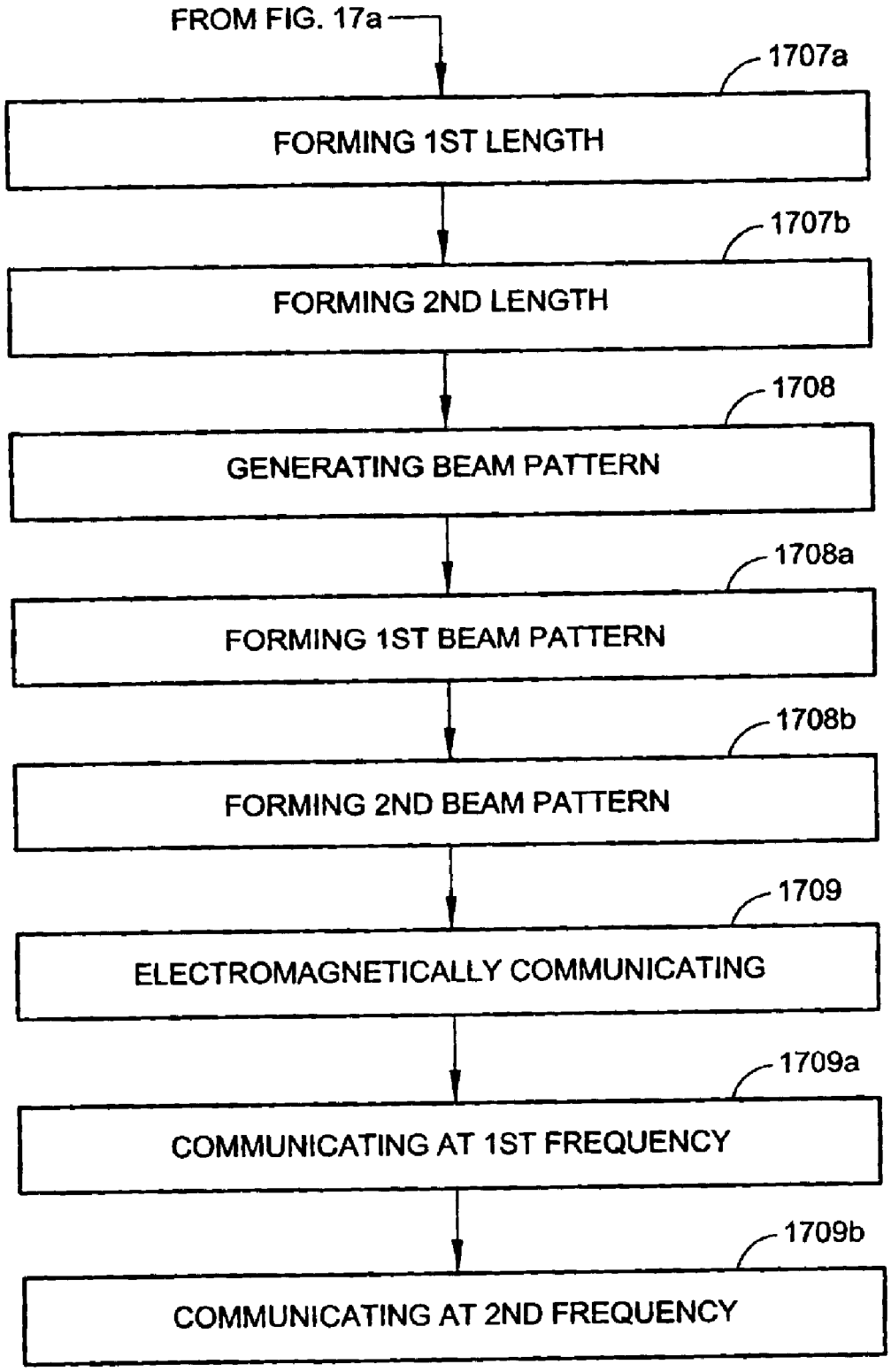

FIGS. 17*a* and 17*b* are flowcharts illustrating the present invention method for beam-forming in an antenna array. Although this method is depicted as a sequence of numbered steps for clarity, no order should be inferred from the numbering unless explicitly stated. It should be understood that some of these steps may be skipped, performed in parallel, or performed without the requirement of maintaining a strict order of sequence. The methods start at Step 1700.

Step 1702 forms a lattice of parasitic elements, proximate to an active element, with each parasitic element including at least one MEMS. Step 1704 selectively connects parasitic element MEMSs. Step 1706 varies the electrical length of the parasitic elements. Step 1708 generates an antenna array beam pattern in response to the parasitic element electrical lengths.

Some aspects of the method include further steps. Step 1701 forms an active element with at least one MEMS. Step 1703 selectively connects the active element MEMS. Step 1707 varies the electrical length of the active element in response to the active element MEMS. Step 1709 electromagnetically communicates at a frequency responsive to the electrical length of the active element.

In some aspects, varying the electrical length of the active element in Step 1707 includes varying the physical length of the active element. Likewise, varying the electrical length of the parasitic elements in Step 1706 includes varying the physical length of parasitic elements.

In other aspects, electromagnetically communicating in Step 1709 includes communicating at a frequency such as 824 to 894 MHz, 1850 to 1990 MHz, 1565 to 1585 MHz, or 2400 to 2480 MHz.

In some aspects of the method, varying the electrical length of the active element in Step 1707 includes substeps. Step 1707*a* forms a first length in response to connecting a first MEMS. Step 1707*b* forms a second length in response to disconnecting the first MEMS. Then, Step 1709 includes substeps. Step 1709*a* electromagnetically communicates at a first frequency responsive to the first length of the active element. Step 1709*b* electromagnetically communicates at a second frequency responsive to the second length of the active element.

In some aspects, varying the electrical length of the active element in Step 1707 includes forming a first plurality of selectable lengths in response to selectively connecting a second plurality of MEMSs. Then, Step 1709 electromagnetically communicates at one of a first plurality of frequencies in response to forming one of the first plurality of selectable lengths of active element.

In other aspects, varying the electrical length of the parasitic elements in Step 1706 includes substeps. Step 1706*a* forms a first plurality of parasitic elements having a first length in response to connecting a corresponding first plurality of parasitic element MEMSs. Step 1706*b* forms a second plurality of parasitic elements having a second length in response to connecting a corresponding second plurality of parasitic element MEMSs.

Then, generating an antenna array beam pattern in response to the parasitic element electrical lengths in Step 1708 includes substeps. Step 1708*a* forms a first beam pattern in response to the first plurality of parasitic elements. Step 1708*b* forms a second beam pattern in response to the second plurality of parasitic elements.

FIG. 18 is a depiction of the present invention antenna array with parasitic elements in a different horizontal plane than the active element. The active element includes a radiator 102 with a length formed along a vertical plane, which extends widthwise across the surface of the sheet. The radiator is bisected in a first horizontal plane, which extends lengthwise across the middle of the sheet. The lattice includes at least one parasitic element 104 having a length parallely aligned to the radiator in the vertical plane and bisected in a second horizontal plane, in response to connecting its corresponding MEMS. The term bisection means that the horizontal plane intersects a portion of the element. The second horizontal plane extends lengthwise across the top of the sheet. As shown, there are two parasitic elements 104 in the second horizontal plane. Note that the array is not limited to any particular number of parasitic elements in a horizontal plane and the two parasitic elements 104 shown in the second horizontal plane need not necessarily be in the same vertical plane.

In some aspects, the lattice includes at least one parasitic element 104 having a length parallely aligned to the radiator in a vertical plane and bisected in a third horizontal plane, in response to connecting their corresponding MEMS. The third horizontal plane extends lengthwise across the bottom of the sheet. Again, there are two parasitic elements 104 shown in the third horizontal plane. Note that the two parasitic elements 104 in the third horizontal plane need not necessarily be in the same vertical plane. Neither is the invention limited to any particular number of parasitic elements per horizontal plane.

Generally, it can be extrapolated from the figure and the earlier descriptions of the lattice formed in a plurality of vertical planes, that a lattice can be formed with a plurality of parasitic elements having a length parallely aligned to the radiator in a vertical plane and bisected in a plurality of horizontal planes, in response to connecting their corresponding MEMS.

Figure 19:
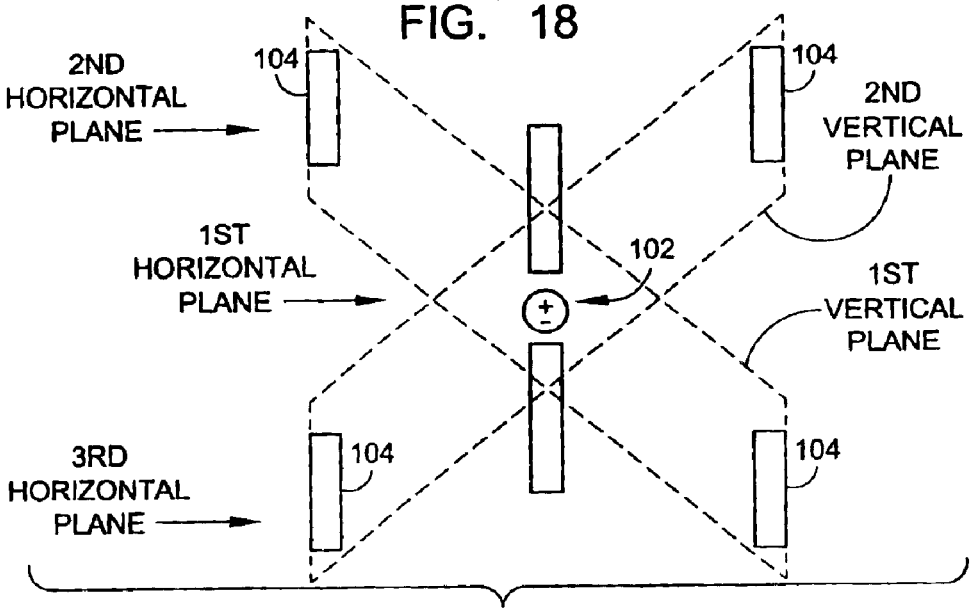
FIG. 19 is a three-dimensional view of the present invention antenna array with parasitic elements in different vertical and horizontal planes.
Figure 20:
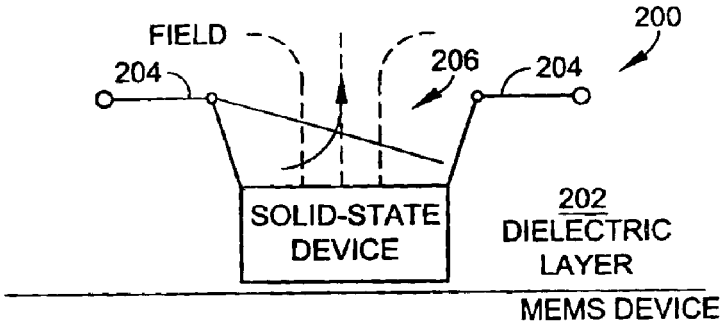
FIG. 20 (PRIOR ART)
FIG. 20 is a schematic diagram of a microelectromechanical switch (MEMS) (prior art).

FIG. 19 is a three-dimensional view of the present invention antenna array with parasitic elements in different vertical and horizontal planes. As shown, the radiator 102 is positioned in the first and second vertical planes and bisected in the first horizontal plane. One parasitic element 104 is shown in the first vertical plane and the second horizontal plane. One parasitic element 104 is shown in the first vertical plane and the third horizontal plane. One parasitic element 104 is shown in the second vertical plane and the second horizontal plane. One parasitic element 104 is shown in the second vertical plane and the third horizontal plane. Note that the invention is not limited to any particular arrangement of parasitic elements. More complicated aspects of the invention (not shown) feature the radiator surrounded by parasitic elements defined as either a cube or spherical shape. Obviously, a greater number of parasitic elements, located in a greater number of vertical and horizontal planes, would provide the greatest control in beam forming.

Generally, it can be extrapolated from the description of the lattice formed in a plurality of vertical and horizontal planes, that a radiator can be formed in a position in a plurality of vertical planes. Then, the lattice would include a plurality of parasitic elements having a length parallely aligned to the radiator in a plurality of vertical planes and bisected in a plurality of horizontal planes, in response to connecting their corresponding MEMS. Such a three-dimensional lattice can be formed using a plurality of intersection dielectric sheets, similar to FIG. 12 for example, or formed as a multilevel dielectric substrate.

A MEMS antenna array has been provided. Various examples of dipole and monopole MEMS antenna arrays have been given. However, these examples only represent a limited number of ways that a MEMS section may be used to vary the physical length of an antenna radiator or parasitic element. Likewise, the invention is not merely limited to the general antenna types used in the examples, as the general concept can be applied to any antenna radiator or parasitic element. Other variations and embodiments of the invention will occur to those skilled in the art.

I claim:

1. A microelectromechanical switch (MEMS) beam-steering antenna array comprising:

an active element including a selectively connectable MEMS and a radiator with a length formed along a first vertical plane and bisected in a first horizontal plane;

a lattice of beam-forming parasitic elements, each including a selectively connectable MEMS, proximate to the active element, the parasitic elements having lengths parallely aligned to the radiator in the first vertical plane and bisected in the first horizontal plane, in response to connecting their corresponding MEMS; and, wherein each MEMS includes:

a dielectric layer; and, a conductive line, with a selectively connectable MEMS conductive section, formed overlying the dielectric layer.

2. The antenna array of claim 1 wherein the active element is a dipole and the radiator has an effective quarter-wavelength odd multiple length at a first frequency responsive to connecting a radiator MEMS and an effective quarter-wavelength odd multiple length at a second frequency responsive to disconnecting the radiator MEMS; and, wherein the active element dipole includes a counterpoise having an effective quarter-wavelength odd multiple length at the first frequency responsive to connecting a counterpoise MEMS and an effective quarter-wavelength odd multiple length at a second frequency responsive to disconnecting the counterpoise MEMS;

wherein each parasitic element has an effective half-wavelength odd multiple length at the first frequency responsive to connecting their corresponding MEMS and an effective quarter-wavelength odd multiple length at a second frequency responsive to disconnecting their corresponding MEMS.

3. The antenna array of claim 1 wherein the active element is a monopole and the radiator has an effective quarter-wavelength odd multiple length at a first frequency responsive to connecting a radiator MEMS and an effective quarter-wavelength odd multiple length at a second frequency responsive to disconnecting the radiator MEMS; and, wherein the active element includes a counterpoise groundplane; and, wherein the parasitic elements are connected to the counterpoise and have an effective quarter-wavelength odd multiple length at the first frequency in response to connecting their corresponding MEMS and an effective quarter-wavelength odd multiple length at a second frequency responsive to disconnecting their corresponding MEMS.

4. The antenna array of claim 1 wherein each MEMS has a mechanical length responsive to connecting its corresponding MEMS conductive section.

5. The antenna array of claim 1 wherein the active element is a dipole and the radiator has an effective quarter-wavelength odd multiple length at a first plurality of frequencies in response to connecting a second plurality of radiator MEMSs;

wherein the active element includes a counterpoise having an effective quarter-wavelength odd multiple length at the first plurality of frequencies in response to connecting a second plurality of counterpoise MEMSs; and wherein each parasitic element has an effective half-wavelength odd multiple length at the first plurality of frequencies in response to connecting their corresponding second plurality of MEMS.

6. The antenna array of claim 1 wherein the active element is a monopole and the radiator has an effective quarter-wavelength odd multiple length at a first plurality of frequencies in response to connecting a second plurality of radiator MEMSs;

wherein the active element includes a counterpoise groundplane; and, wherein the parasitic elements are connected to the counterpoise and have an effective quarter-wavelength odd multiple length at the first plurality of frequencies in response to connecting their corresponding MEMS.

7. The antenna array of claim 1 wherein the radiator has a position in a second vertical plane; and, wherein the lattice includes parasitic elements having lengths parallely aligned to the radiator in the second vertical plane and bisected in the first horizontal plane, in response to connecting their corresponding MEMS.

8. The antenna array of claim 7, wherein the radiator has a position in a third vertical plane; and, wherein the lattice includes parasitic elements having lengths parallely aligned to the radiator in the third vertical plane and bisected in the first horizontal plane, in response to connecting their corresponding MEMS.

9. The antenna array of claim 8 wherein the radiator has a position in a fourth vertical plane;

wherein the lattice includes parasitic elements having lengths parallely aligned to the radiator in the fourth vertical plane and bisected in the first horizontal plane, in response to connecting their corresponding MEMS.

10. The antenna array of claim 9 wherein the radiator has a position in a fifth vertical plane; and, wherein the lattice includes parasitic elements having lengths parallely aligned to the radiator in the fifth vertical plane and bisected in the first horizontal plane, in response to connecting their corresponding MEMS.

11. The antenna array of claim 10, wherein the radiator has a position in a sixth vertical plane; and, wherein the lattice includes parasitic elements having lengths parallely aligned to the radiator in the sixth vertical plane and bisected in the first horizontal plane, in response to connecting their corresponding MEMS.

12. The antenna array of claim 9 wherein the parasitic elements in the first vertical plane are orthogonal to the parasitic elements in the second vertical plane; and, wherein the parasitic elements in the third vertical plane are orthogonal to the parasitic elements in the fourth vertical plane.

13. The antenna array of claim 11 wherein the parasitic elements in the first vertical plane are orthogonal to the parasitic elements in the second vertical plane;

wherein the parasitic elements in the third vertical plane are orthogonal to the parasitic elements in the fourth vertical plane; and, wherein the parasitic elements in the fifth vertical plane are orthogonal to the parasitic elements in the sixth vertical plane.

14. The antenna array of claim 7 wherein a first plurality of parasitic elements form a second plurality of vertical planes though the radiator position, in response to connecting their corresponding MEMS.

15. The antenna array of claim 8 wherein a plurality of parasitic elements are formed on a first sheet of dielectric material having sheet length and a sheet width in the first vertical plane.

16. The antenna array of claim 15 wherein a plurality of parasitic elements are formed on a second sheet of dielectric material having sheet length and a sheet width in the second vertical plane.

17. The antenna array of claim 16, wherein a plurality of parasitic elements are formed on a third sheet of dielectric material having sheet length and a sheet width in the third vertical plane.

18. The antenna array of claim 17 wherein a plurality of parasitic elements are formed on a fourth sheet of dielectric material having sheet length and a sheet width in the fourth vertical plane.

19. The antenna array of claim 15 wherein the radiator includes a conductive line formed on the first dielectric sheet.

20. The antenna array of claim 7 wherein a first plurality parasitic elements are formed on a second plurality of dielectric sheets each having a sheet length and a sheet width in a second plurality of vertical planes.

21. The antenna array of claim 8 wherein at least one parasitic element is formed on a first sheet of dielectric material having sheet length and a sheet width in the first vertical plane;

wherein at least one parasitic element is formed on a second sheet of dielectric material having a sheet length and a sheet width in the first vertical plane; and, wherein the radiator is interposed between the first and second sheets in the first vertical plane.

22. The antenna array of claim 21 wherein at least one parasitic element is formed on a third sheet of dielectric material having sheet length and a sheet width in the second vertical plane;

wherein at least one parasitic element is formed on a fourth sheet of dielectric material having a sheet length and a sheet width in the second vertical plane; and, wherein the radiator is interposed between the third and fourth sheets in the second vertical plane.

23. The antenna array of claim 22 wherein at least one parasitic element is formed on a fifth sheet of dielectric material having sheet length and a sheet width in the third vertical plane;

wherein at least one parasitic element is formed on a sixth sheet of dielectric material having a sheet length and a sheet width in the third vertical plane; and, wherein the radiator is interposed between the fifth and sixth sheets in the third vertical plane.

24. The antenna array of claim 23 wherein at least one parasitic element is formed on a seventh sheet of dielectric material having sheet length and a sheet width in the fourth vertical plane;

wherein at least one parasitic element is formed on an eighth sheet of dielectric material having a sheet length and a sheet width in the fourth vertical plane; and, wherein the radiator is interposed between the seventh and eighth sheets in the fourth vertical plane.

25. The antenna array of claim 1 wherein the active element includes a plurality of selectively connectable MEMSs; and, wherein each parasitic element includes a plurality of selectively connectable MEMSs.

26. The antenna array of claim 1 wherein the active element includes at least one fixed-length conductive section; and, wherein each parasitic element includes at least one fixed-length conductive section.

27. The antenna array of claim 26 wherein the active element includes a fixed-length conductive section and a plurality of MEMSs; and, wherein each parasitic element includes a fixed-length conductive section and a plurality of MEMSs.

28. The antenna array of claim 27 wherein the active element includes a plurality of fixed-length conductive sections and a plurality of MEMSs; and, wherein each parasitic element includes a plurality of fixed-length conductive sections and a plurality of MEMSs.

29. The antenna array of claim 1 wherein the active element includes a fixed-length conductive section in series with a MEMS;

wherein each parasitic element includes a fixed-length conductive section in series with a MEMS.

30. The antenna array of claim 29 wherein the active element includes a fixed-length conductive section in series with a plurality of MEMSs; and, wherein each parasitic element includes a fixed-length conductive section in series with a plurality of MEMSs.

31. The antenna array of claim 30 wherein the active element includes a plurality of fixed-length conductive sections in series with a plurality of MEMSs; and, wherein each parasitic element includes a plurality of fixed-length conductive sections in series with a plurality of MEMSs.

32. The antenna array of claim 1 wherein the active element includes a radiator with a width and a plurality of MEMSs parallely aligned along the radiator width; and, wherein each parasitic element has a width and includes a plurality of MEMSs parallely aligned along the width.

33. The antenna array of claim 1 wherein the active element includes a radiator with a length and a plurality of MEMSs aligned along the radiator length; and, wherein each parasitic element has a length and a plurality of MEMSs aligned along the length.

34. The antenna array of claim 14 wherein the active element communicates at frequencies selected from the group including 824 to 894 megahertz (MHz), 1850 to 1990 MHz, 1565 to 1585 MHz, and 2400 to 2480 MHz.

35. The antenna array of claim 1 wherein the MEMS has a control input, a signal input, and a signal output selectively connected to the signal input in response to the control signal.

36. The antenna array of claim 1 wherein the MEMS has a control input, a signal input, and a plurality of signal outputs, with one of the signal outputs selectively connected to the signal input in response to the control signal.

37. The antenna array of claim 36 wherein the active element includes a radiator with a first plurality of fixed-length conductive sections connected to a first plurality of MEMS signal outputs, the radiator having an effective quarter-wavelength odd multiple length at the first plurality of frequencies in response to connecting one of the first plurality of radiator fixed length conductive sections through the radiator MEMS; and, wherein each parasitic element includes a first plurality of fixed-length conductive sections connected to a first plurality of signal outputs of their corresponding MEMS, each parasitic element having an effective quarter-wavelength odd multiple length at the first plurality of frequencies in response to connecting one of the first plurality of fixed length conductive sections through their corresponding MEMS.

38. A wireless telephone communications device comprising:

a transceiver with an antenna port; and, a MEMS antenna array including:

an active element including a selectively connectable MEMS, and a radiator with a length formed along a first vertical plane and bisected in a first horizontal plane; and, a lattice of beam-forming parasitic elements, including selectively connectable MEMSs, proximate to the active element, the parasitic elements having lengths parallely aligned to the radiator in the first vertical plane and bisected in the first horizontal plane, in response to connecting their corresponding MEMS; and wherein each MEMS includes:

a dielectric layer; and, a conductive line, with a selectively connectable MEMS conductive section, formed overlying the dielectric layer.

39. The wireless communications device of claim 38 wherein the active element is a dipole.

40. The wireless communications device of claims 38 wherein the active element is a monopole.

41. The wireless communications device of claim 38 wherein the antenna array communicates at frequencies selected from the group including 824 to 894 megahertz (MHz), 1850 to 1990 MHz, 1565 to 1585 MHz, and 2400 to 2480 MHz.

42. A method for beam-forming in an antenna array, the method comprising:

forming an active element with a selectively connectable MEMS, and a radiator with a length formed along a first vertical plane and bisected in a first horizontal plane;

forming a lattice of parasitic elements, proximate to an active element, with each parasitic element including at least one microelectromechanical switch (MEMS), the parasitic elements having lengths parallely aligned to the radiator in the first vertical plane;

selectively connecting parasitic element MEMSs;

bisected the parasitic elements in the first horizontal plane, in response to connecting their corresponding MEMS;

varying the electrical length of the parasitic elements; and, generating an antenna array beam pattern in response to the parasitic element electrical lengths.

43. The method of claim 42 further comprising:

selectively connecting the active element MEMS;

varying the electrical length of the active element in response to the active element MEMS; and, electromagnetically communicating at a frequency responsive to the electrical length of the active element.

44. The method of claim 43 wherein varying the electrical length of the active element includes varying the physical length of the active element; and, wherein varying the electrical length of the parasitic elements includes varying the physical length of parasitic elements.

45. The method of claim 44 wherein electromagnetically communicating includes communicating at a frequency selected from the group including 824 to 894 megahertz (MHz), 1850 to 1990 MHz, 1565 to 1585 MHz, and 2400 to 2480 MHz.

46. The method of claim 43 wherein varying the electrical length of the active element includes:

forming a first length in response to connecting a first MEMS; and, forming a second length in response to disconnecting the first MEMS.

47. The method of claim 46 further comprising:

electromagnetically communicating at a first frequency responsive to the first length of the active element; and, electromagnetically communicating at a second frequency responsive to the second length of the active element.

48. The method of claim 43 wherein varying the electrical length of the active element includes forming a first plurality of selectable lengths in response to selectively connecting a second plurality of MEMSs.

49. The method of claim 48 further comprising:

electromagnetically communicating at one of a first plurality of frequencies in response to forming one of the first plurality of selectable lengths of active element.

50. The method of claim 43 wherein varying the electrical length of the parasitic elements includes:

forming a first plurality of parasitic elements having a first length in response to connecting a corresponding first plurality of parasitic element MEMSs; and, forming a second plurality of parasitic elements having a second length in response to connecting a corresponding second plurality of parasitic element MEMSs.

51. The method of claim 50 wherein generating an antenna array beam pattern in response to the parasitic element electrical lengths includes:

forming a first beam pattern in response to the first plurality of parasitic elements; and, forming a second beam pattern in response to the second plurality of parasitic elements.

* * * * *